US007320149B1

(12) United States Patent
Huffman et al.

(10) Patent No.: US 7,320,149 B1
(45) Date of Patent: Jan. 22, 2008

(54) ROBOTIC EXTRACTION CLEANER WITH DUSTING PAD

(75) Inventors: Eric C. Huffman, Lowell, MI (US); Jonathan L. Miner, Rockford, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 604 days.

(21) Appl. No.: 10/707,130

(22) Filed: Nov. 21, 2003

Related U.S. Application Data

(60) Provisional application No. 60/319,722, filed on Nov. 22, 2002.

(51) Int. Cl.
*A47L 7/00* (2006.01)

(52) U.S. Cl. ..... 15/320; 15/319; 15/340.3; 15/401; 15/403

(58) Field of Classification Search ..... 15/319, 15/340.1, 340.3, 340.4, 320, 393, 403
See application file for complete search history.

(56) References Cited

U.S. PATENT DOCUMENTS

| | | | | |
|---|---|---|---|---|
| 4,369,543 | A * | 1/1983 | Chen et al. | 15/319 |
| 5,032,775 | A | 7/1991 | Mizuno et al. | 701/25 |
| 5,279,672 | A | 1/1994 | Betker et al. | 134/18 |
| 5,309,592 | A * | 5/1994 | Hiratsuka | 15/319 |
| 5,548,511 | A * | 8/1996 | Bancroft | 15/319 |
| 5,787,545 | A * | 8/1998 | Colens | 15/319 |
| 5,815,880 | A | 10/1998 | Nakanishi | 15/319 |
| 5,959,423 | A | 9/1999 | Nakanishi et al. | 318/568.12 |
| 5,995,844 | A | 11/1999 | Fukuda | 455/462 |
| 5,995,884 | A | 11/1999 | Allen et al. | 701/24 |
| 6,446,302 | B1 * | 9/2002 | Kasper et al. | 15/319 |
| 6,457,206 | B1 | 10/2002 | Judson | 15/320 |
| 6,459,955 | B1 | 10/2002 | Bartsch et al. | 700/245 |
| 6,481,515 | B1 | 11/2002 | Kirkpatrick et al. | 180/65.1 |
| 6,580,246 | B2 | 6/2003 | Jacobs | 318/568.16 |
| 6,594,844 | B2 | 7/2003 | Jones | 15/49.1 |
| 6,633,150 | B1 | 10/2003 | Wallach et al. | 310/568.12 |
| 6,925,679 | B2 * | 8/2005 | Wallach et al. | 15/319 |
| 6,938,298 | B2 * | 9/2005 | Aasen | 15/319 |
| 2004/0031113 | A1 * | 2/2004 | Wosewick et al. | 15/319 |
| 2004/0031121 | A1 * | 2/2004 | Martin et al. | 15/403 |

* cited by examiner

*Primary Examiner*—Theresa T. Snider
(74) *Attorney, Agent, or Firm*—McGarry Bair PC

(57) ABSTRACT

An vacuum cleaning robot has a drive system adapted to autonomously move a base housing along a horizontal surface and is controlled by a computer processing unit. A dusting assembly is mounted to the base housing and is adapted to selectively rest on a surface to be cleaned. A suction source draws dirt and debris through a suction nozzle and deposits the same in the recovery tank. A power source is connected to the drive system and to the computer processing unit. The computer processing unit is adapted to direct horizontal movement of the base housing within boundaries of the surface to be cleaned based upon input data defining said boundaries.

19 Claims, 8 Drawing Sheets

ROBOTIC EXTRACTION CLEANER WITH DUSTING PAD

CROSS REFERENCE TO RELATED APPLICATIONS

This application claims the benefit of U.S. Provisional Application Ser. No. 60/319,722, filed Nov. 22, 2002.

BACKGROUND OF INVENTION

A home cleaning robot comprising a platform in combination with a cleaning implement, for example a non-woven electrostatic cloth, and a motive force to autonomously move the platform is disclosed in U.S. Pat. No. 6,459,955 to Bartsch et al. The robot moves randomly about a surface while cleaning the surface with the cloth. U.S. Pat. No. 6,481,515 to Kirkpatrick et al. describes a similar device with a surface treating sheet and also includes a chamber for storing fluid that is applied to the surface through the surface treating means. Another robotic floor cleaner disclosed in U.S. Patent Application Publication No. 2002/0002751 to Fisher utilizes disposable cleaning sheets, such as dust cloths, engaged with several sheet holder receptacles on a compliant pad. The robotic floor cleaner further comprises an appendage that can have several functions, including a sheet holder or a fluid dispenser. The U.S. Pat. No. 6,633,150 to Wallach et al. discloses a mobile robot that mops a surface by pressing a damp towel, which is mounted to the body of the robot, against the ground as the robot moves back and forth. One limitation of these types of robot cleaners is that larger debris is pushed in front of the robot without being picked up. Another limitation is that the larger debris tends to clog or bind the cloth, thus reducing the useful life of the cloth. A further limitation is that this type of cleaner does not have the capacity to pretreat and agitate stubborn sticky stains, especially from hard surfaces.

An automatic robotic vacuum cleaner integrating a drive system, a sensing systems, and a control system with a microprocessor is disclosed in U.S. Patent Application Publication No. 2003/0060928. Examples of commercially available robotic vacuum cleaners include the Roomba vacuum cleaner from iRobot, the Karcher RoboVac, the Robo Vac from Eureka, the Electrolux Trilobite, and the LG Electronics Robot King. Additionally, U.S. Pat. No. 6,594,844 to Jones discloses an obstacle detection system for a robot that is said to dust, mop, vacuum, and/or sweep a surface such as a floor. One limitation of such automatic robotic vacuum cleaners is that fine or embedded debris, such as liquid stains, cannot effectively be removed by a dry vacuum system alone.

U.S. Pat. No. 6,457,206 to Judson discloses a remote-controlled vacuum cleaner that is operable in an automatic mode and has a mister for distributing cleaning solution or water onto the surface to loosen debris during movement of the vacuum cleaner. U.S. Pat. No. 5,309,592 to Hiratsuka discloses a cleaning robot having rotary brushes and a squeegee to collect soiled water and dust for removal by suction. Further examples of robotic cleaners are disclosed in U.S. Pat. No. 5,279,672 to Betker et al., U.S. Pat. No. 5,032,775 to Mizuno et al., and U.S. Pat. No. 6,580,246 to Jacobs, which all disclose devices that comprise some type of fluid dispensing system, agitation system, and vacuum/fluid collection system.

SUMMARY OF INVENTION

According to the invention, an autonomously movable home cleaning robot comprises a base housing, a drive system mounted to said base housing wherein the drive system is adapted to autonomously move the base housing on a substantially horizontal surface having boundaries. Further, a computer processing unit for storing, receiving and transmitting data is attached to said base housing, a dusting assembly is operatively associated with the base housing and is adapted to selectively rest on a surface to be cleaned. A suction nozzle is mounted on the base housing for withdrawing dirt and debris from the surface to be cleaned and a recovery tank is mounted on the base housing and is in fluid communication with the suction nozzle. A suction source is mounted to the base housing and is in fluid communication with the suction nozzle and the recovery tank for drawing dirt and debris through the suction nozzle and for depositing the same in the recovery tank. A power source is connected to the drive system and to the computer processing unit. The computer processing unit is adapted to direct horizontal movement of the base housing within the boundaries of the surface to be cleaned based upon input data defining said boundaries.

In one embodiment, the cleaning robot further comprises a cleaning fluid delivery system for depositing a cleaning fluid on the surface to be cleaned. Further, an agitator can be mounted on the base housing for agitating contact with the surface to be cleaned.

Preferably, the cleaning robot further includes floor condition sensors mounted on the base housing for detecting a floor condition and for generating a control signal that forms a part of the input data to the computer processing unit. Further, the computer processing unit controls at least one of the agitator, the delivery of fluid by the fluid delivery system, the suction source and the drive system in response to the control signal. In a preferred embodiment, proximity sensors are mounted on base housing for detecting the boundaries of the surface to be cleaned and for generating a second control signal that forms a part of the input data to the computer processing unit. The computer processing unit controls the drive system in response to the second control signal to keep the base housing within the boundaries of the surface to be cleaned.

In one embodiment, the input data is a remote control signal. In another embodiment, the input data comprises a program that guides the base assembly through a predetermined path on the surface to be cleaned.

Typically, the drive system comprises at least one wheel that is driven by a drive motor.

In a preferred embodiment, the dusting cloth is removably mounted to a pad that forms a support for the dusting cloth.

Further according to the invention, a method of autonomously cleaning a surface comprising the steps of: applying a suction force to the surface through a suction nozzle to remove dirt and debris from the surface, collecting the removed dirt and debris in a collection chamber, substantially simultaneously applying a dusting cloth to the surface to be cleaned and guiding the application of the suction force and the dusting cloth with the use of input data to a central processing unit.

DETAILED DESCRIPTION

Figure 1:
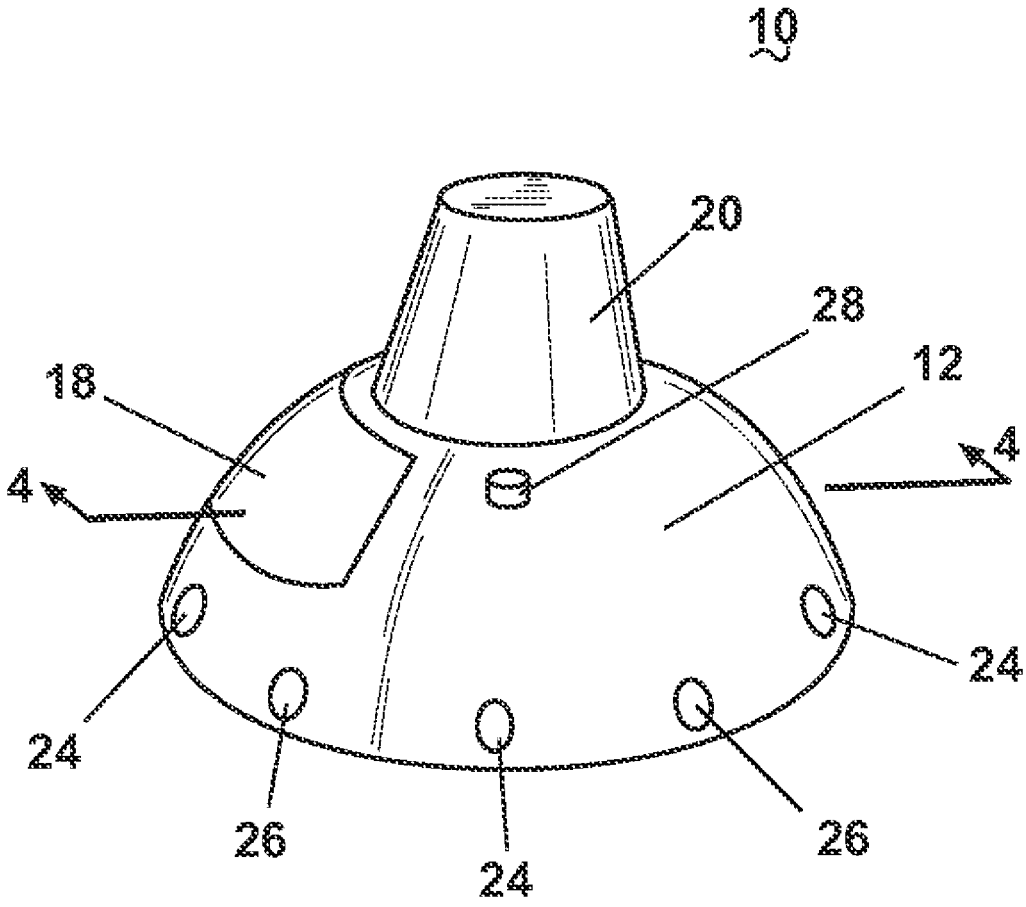
FIG. 1 is a perspective view of the robotic extraction cleaner with dusting pad according to the invention.
Figure 2:
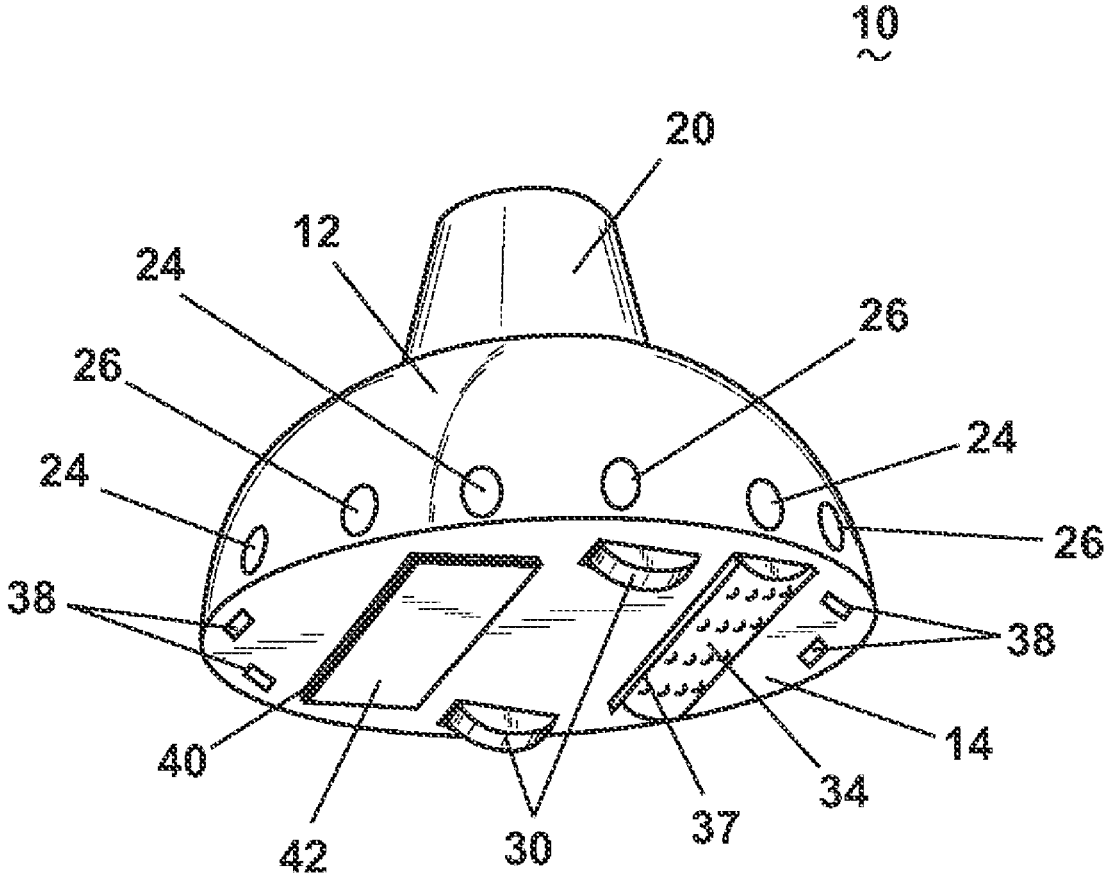
FIG. 2 is a perspective bottom view of the robotic extraction cleaner with dusting pad in the operating position as shown in FIG. 1.
Figure 3:
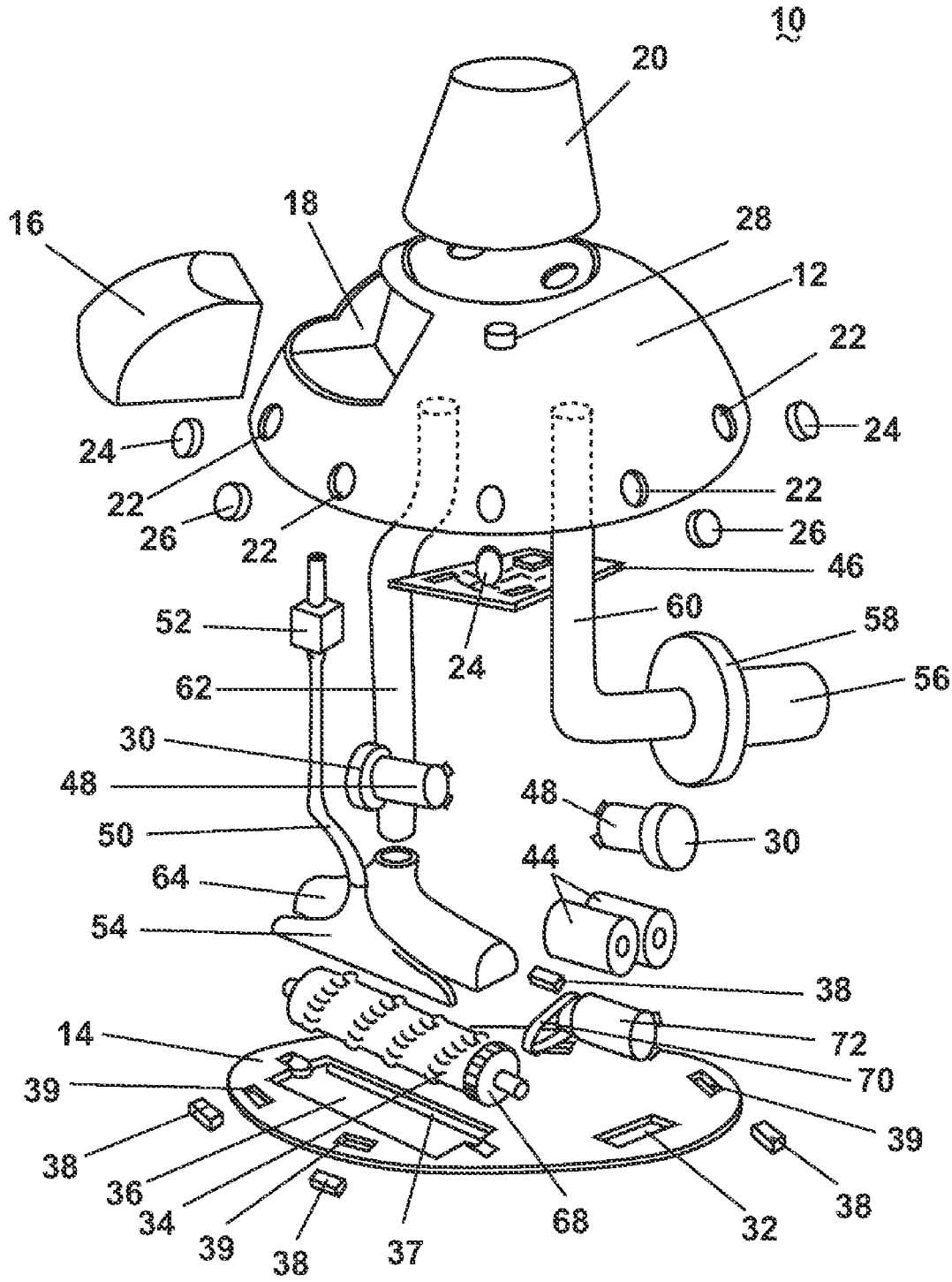
FIG. 3 is an exploded view of the robotic extraction cleaner with dusting pad shown in FIG. 1.

Referring to FIGS. 1-3, a robotic extraction cleaner 10 with dusting pad is described and comprises robotic platform further comprising a top enclosure 12 and a base housing 14. The base housing 14 provides the basic structure for the robotic platform on which all other components depend for structural support. A clean solution tank 16 is removably mounted in a solution tank recess 18 formed within the top enclosure 12. A generally conical shaped recovery tank 20 is removably mounted to a flat surface formed on a top surface of top enclosure 12. A plurality of proximity sensors 24, 26 are located within corresponding sensor apertures 22 around the outer periphery of the top enclosure 12. The proximity sensors 24, 26 comprise any one or combination of commonly known sensors including infrared sensors 24, pressure sensitive sensors 26, or ultrasonic sensors affixed to the top enclosure 12 in alternating or parallel fashion. Alternating the arrangement of proximity sensors 24, 26 provides redundancy and allows for improved motion control of the robotic platform as it encounters obstacles within the room being cleaned. An electrical power switch 28 is located on a top surface of the top enclosure 12, preferably near the recovery tank 20, and controls the flow of power from one or more batteries 44 to a logic board 46, both mounted to the base housing 14 within a cavity formed by the top enclosure 12.

Alternatively, or in combination with the proximity sensors 24, 26, a predetermined path is programmed in to the central processing unit by the user. In yet another embodiment, the path is dictated to the central processing unit via a remote control device.

Referring to FIGS. 2 and 3, a drive system comprises a pair of drive wheels 30 that protrude through corresponding drive wheel apertures 32 which are located in spaced relation near the outer perimeter of the base 14. A brush roll 34 protrudes through a corresponding suction aperture 36 forming a forward portion of the base 14. A plurality of floor condition sensors 38 are mounted within corresponding condition sensor apertures 39 located through the bottom surface of the base 14 on both the forward and rearward portion of the base 14. A dusting pad 40 is attached to a bottom surface of the base 14 behind and in spaced relation to the brush roll 34 and the drive wheels 30. The dusting pad 40 is preferably hinged to a bottom surface of the base 14, however other commonly known fastening methods such as detents, latches, screws, snaps or hook and loop fasteners can also be used to secure the dusting pad 40 to the base 14. The dusting pad 40 and brush roll 34 are positioned in a generally parallel fashion with respect to the drive wheels 30. A removable dusting cloth 42 wraps around, and is held by, the dusting pad 40 as will be described further herein.

Referring again to FIG. 3, a power source comprising a plurality of batteries 44, which may be any commonly known battery source including alkaline, rechargeable nickel-cadmium, NiMH, or LiMH are located on base assembly 14. When rechargeable batteries are used, a commonly known recharging circuit is used to transform available facility voltage to a level usable for the batteries 44. A charging plug connected to the transformer is manually or automatically attached to a corresponding jack connected to the batteries thereby completing the circuit and allowing the batteries to charge. A commonly known computer processing unit further comprising a logic board 46 is located between the base 14 and the top enclosure 12. The logic board 46 comprises a commonly known printed circuit board upon which commonly known computer processing and electronic components are mounted configured in a manner similar to that described by U.S. Pat. No. 6,459,955 to Bartsch et al. which is incorporated by reference herein in its entirety. Power from the batteries 44 is controlled by the switch 28. When switch 28 is on, power flows to the logic board 46. When the switch 28 is off, no power flows to the logic board 46. The logic board 46 receives inputs from the various sensors 24, 26, 38 and provides conditioned output to drive the drive wheels 30 and regulate operation of solution delivery, suction, and brush rotation. One example of such a logic board is that used in the commercially available TALRIK II robot manufactured by Mekatronix which is incorporated herein by reference.

Referring to FIG. 3, a drive system further comprising a plurality of reversible direct current (DC) drive motors 48 are preferably mounted on an upper surface of the base 14 perpendicular to each of the drive apertures 32. Alternatively, the drive motors 48 may be mounted on the lower surface of the base 14 or on a separate suspension plate (not shown). The drive motors 48 are directly coupled to the center of each drive wheel 30 such that rotation of the motor results in a corresponding rotation of the drive wheel 30. Energy to power the drive motors 48 is delivered from the logic board 46 to the drive motors 48 via commonly known wiring (not shown).

Referring to FIG. 2, a floor condition sensor system comprising a plurality of floor condition sensors 38 are mounted to the bottom surface of the base 14. Each sensor 38 provides signals relative to the condition of the surface being cleaned to the logic board 46 for processing. The logic board 46, in turn, processes those signals and provides output to control the action of the fluid distribution system, fluid recovery system, or brush agitation. One such example of a floor condition sensing apparatus is shown in U.S. Pat. No. 6,446,302 to Kasper et al. issued on Sep. 10, 2002 and is hereby incorporated herein by reference in its entirety.

Figure 4:
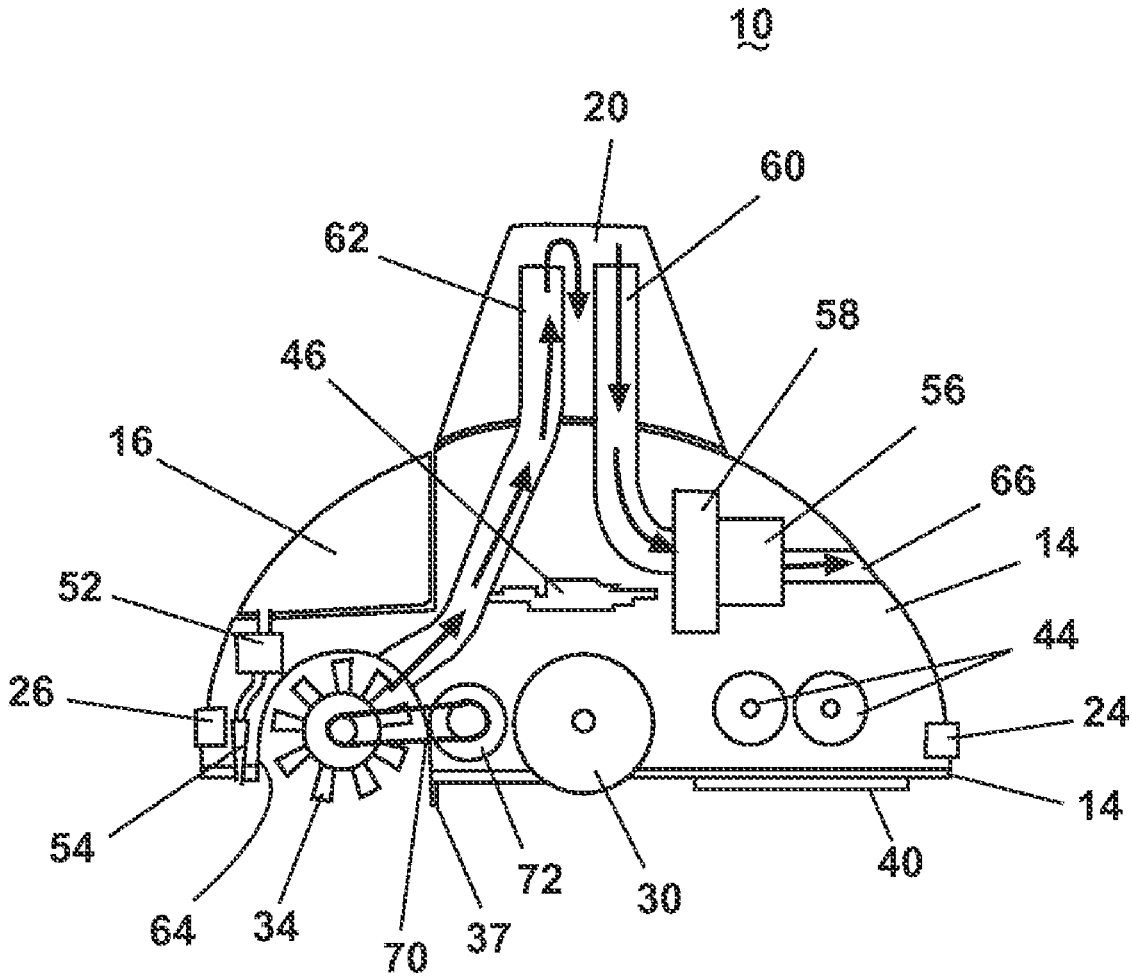
FIG. 4 is a partial cross-sectional side view of the base assembly taken across line 4-4 of FIG. 1.

Referring to FIGS. 3 and 4, a fluid distribution system comprises a clean solution tank 16, a solution conduit 50, a solution solenoid valve 52, and a spray bar 54 or spray tip. Alternatively, the solution system can include a fluid pump to move solution under pressure from the solution tank 16 to the spray bar 54 or a spray tip. The clean solution tank 16 is removably mounted in a tank recess 18 formed within the top enclosure 12. Solution tank 16 further includes a commonly known, normally closed, removable solution delivery valve (not shown). The delivery valve may be selectively removed to gain access to a solution tank inlet (not shown) filling the solution tank 16 with the necessary water and cleaning solutions. Alternatively, the delivery valve may be fixedly secured to the solution tank 16 and filling may be accomplished through a secondary inlet opening with an associated resealable cap. With the solution tank 16 removed from the top enclosure 12, a spring forces the delivery valve closed to retain solution within the tank. When the solution tank 16 is inserted into the top enclosure 12, a nub on a corresponding fitting (not shown) depresses the delivery valve and opens up a path for the solution to flow through. The solenoid valve 52 is electrically operated upon command from the logic board 46 and controls the flow of solution through the solution conduit 50. The spray bar 54 comprises a hollow chamber creating a manifold that includes a series of apertures along the length of the manifold. In operation, solution is allowed to flow through the manifold by gravitational force to the surface being cleaned. One example of such a gravity feed solution delivery system on an upright extraction cleaner is found in U.S. Pat. No. 6,467,122 to Lenkiewicz et al. and is incorporated herein by reference in its entirety.

Again referring to FIGS. 3 and 4, a fluid recovery system for withdrawing wet or dry debris from the surface to be cleaned comprises a suction motor 56, a suction fan 58, a working air outlet 60, the recovery tank 20, a working air inlet 62, a suction nozzle 64, and a suction motor exhaust 66. The suction motor 56 receives power as needed from the logic board 46. The suction fan 58 is directly coupled to the suction motor 56 and is free to rotate within a fan housing. Rotation of the fan 58 creates a working airflow that lifts and carries debris from the surface as indicated by the arrows in FIG. 4. In the preferred embodiment, suction nozzle 64 is in fluid communication with a chamber in which the brush roll 34 resides. Alternatively, suction nozzle 64 may bypass the brush roll 34 and chamber and is located forward of the brush roll 34 is located in close proximity to the surface to be cleaned. In operation, the rotating fan 58 draws air and entrained debris from the suction nozzle 64, through the working air inlet 62, and into the recovery tank 20. Liquid and debris in the working air are separated within the recovery tank 20 due to gravity pulling the debris to the bottom of the tank. Clean working air, free of debris that settled into the recovery tank 20, moves into the working air outlet 60 into the fan housing, through the fan 58. The motor exhaust 66 is located on an outer surface of the top enclosure 12 and is in fluid communication with the suction motor 56 and the suction fan 58. Therefore, working air passing over the suction motor 56 is allowed to exit the enclosure 12 at the motor exhaust 66. This commonly known fluid recovery system is also described in U.S. Pat. No. 6,467,122.

Referring to FIGS. 2, 3 and 4, an agitation system is described comprising at least one brush roll 34, a brush roll gear 68, a belt 70, and a brush drive source. The brush roll 34 is mounted horizontally within, and protrudes below the suction aperture 36 formed in the base 14. Furthermore, the suction nozzle 64 is sealing mated to the suction aperture 36. A pliable squeegee 37 is affixed to a rear edge of the suction aperture 36 and is in contact with the surface being cleaned. The brush roll 34 resides in a cavity formed within the suction aperture 36 and the suction nozzle 64. The brush roll 34 is preferably a cylindrical dowel with flexible bristles protruding therefrom. Alternatively, the brush roll 34 comprises a plurality of pliable paddles in combination with, or separate from the bristles. An axle runs longitudinally through the center axis of the brush roll 34. In another embodiment, pair of counter-rotating brush rolls 34 are used in place of the single brush roll 34. Alternatively, the brush rolls 34 may rotate in the same direction. The brush roll gear 68 is fixedly attached to one of the axles. The axles rotate within commonly known bearings located on both sides of the suction aperture 36. A belt 70 engages the brush roll gear 68 on one end and is attached to a drive gear on the other. In the preferred embodiment, brush drive is provided by an electric brush motor 72. Power to the brush motor 72 is supplied by outputs from the logic board 46. The brush motor 72 is suitably mounted on an upper surface of the base 14 in such a manner that the drive gear on the brush motor 72 is in alignment with the brush roll gear 68. This commonly known agitation system is also described in U.S. Pat. No. 6,467,122. In an alternate embodiment, the electric brush motor 72 is replaced with an air driven turbine that receives its airflow from the suction fan 58. In yet another embodiment, the brush motor 72 is eliminated and the drive belt 70 is connected to a shaft protruding from the suction motor 56. In yet another embodiment, brush drive is accomplished via the drive wheel motor 48 through a secondary gear attached to a protruding shaft.

Figure 5:
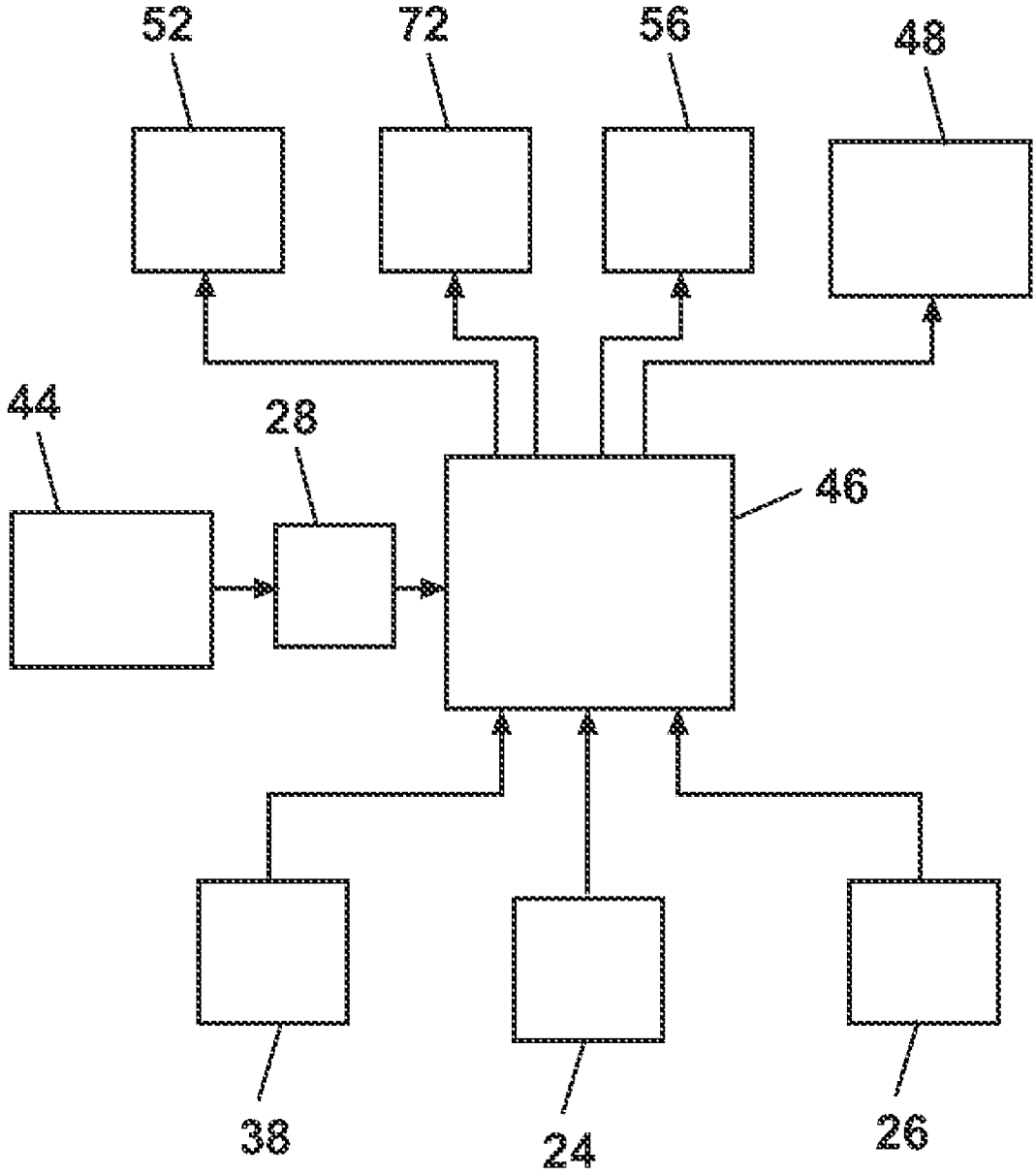
FIG. 5 is a schematic block diagram of the robotic extraction cleaner with dusting pad as shown in FIG. 1.
Figure 6:
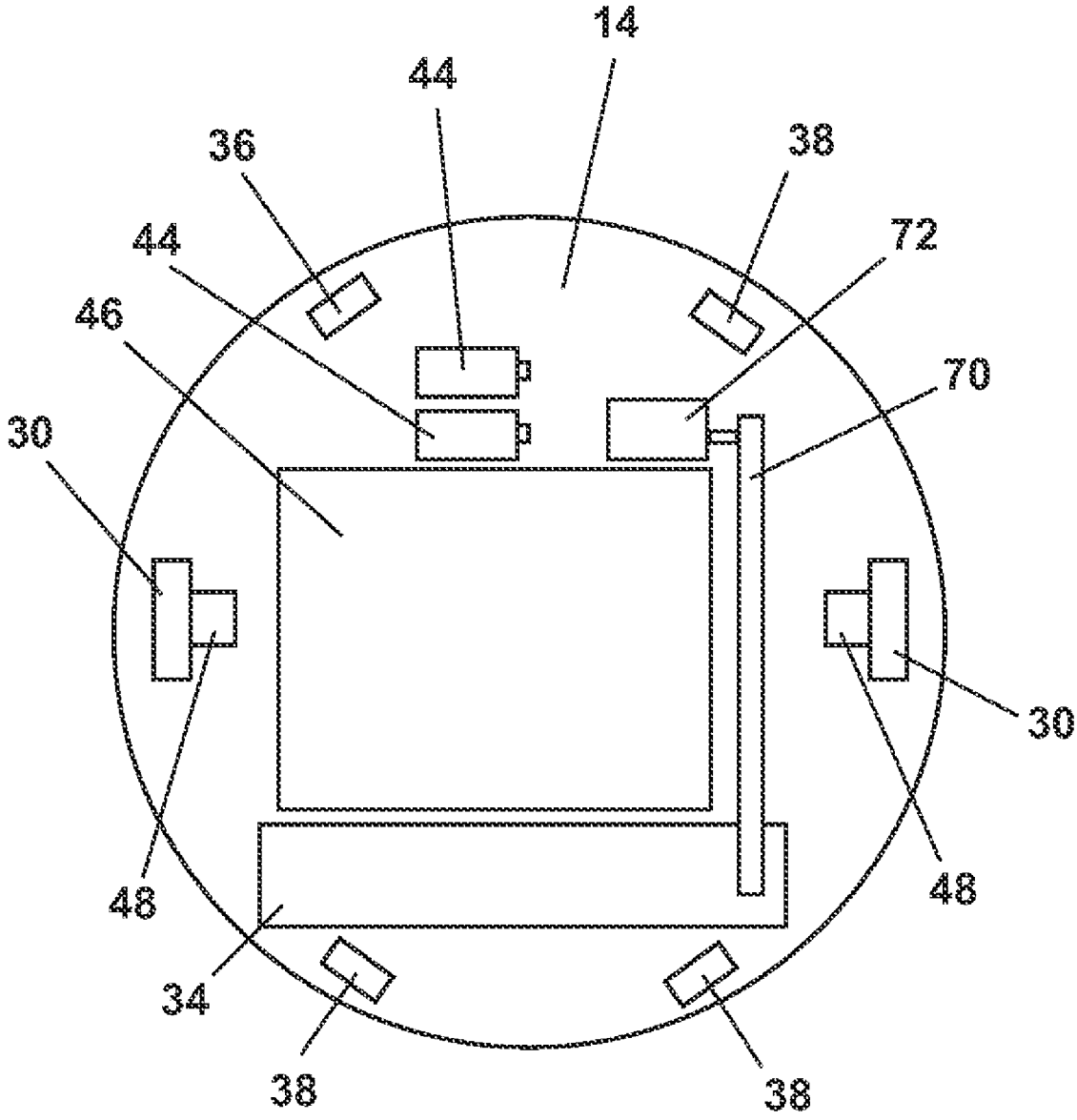
FIG. 6 is a plan view of the robotic extraction cleaner with dusting pad as shown in FIG. 1.

The various components work together to control the robotic extraction cleaner 10 as depicted schematically in FIG. 5 and shown in plan view in FIG. 6. Power is supplied to the logic board 46 through the batteries 44 via the power switch 28. The proximity sensors 24, 26 and the floor condition sensors 38 provide inputs to the logic board 46. The logic board 46 processes the inputs and selectively sends appropriate output signals to the drive wheels 30, solution solenoid valve 52, brush motor 72, and optionally to the suction motor 56.

The infra-red proximity sensors 24 emit an infra-red light beam that is reflected from surrounding objects and detected by the sensor 24. The pressure-sensitive proximity sensors 26 are activated by direct contact with a stationary object, closing a conductive path within the sensor 26 and providing a signal to the logic board 46. The floor condition sensors 38 measure the amount of discoloration in the surface being cleaned and transmits an appropriate signal to the logic board 46. When activated, the robot extraction cleaner 10 normally moves in a generally straight and forward direction because equal outputs are provided to each drive motor 48. Output signals to the individual drive motors 48 change as inputs from the various sensors change. For example, when one or more of the proximity sensors 24, 26 detect a stationary object, output to a corresponding drive wheel 30 is slowed. Since the drive wheels 30 are now moving at different speeds, the robot extractor turns in the direction of the slower turning wheel.

The floor condition sensors 38 measure the relative degree of soil on the surface being cleaned by sensing color variation. As surface color variations are encountered, output to the drive wheels 30 is slowed and possibly stopped depending upon the amount of color variation detected. Output signals are then generated by the logic board 46 and transmit control signals to either the brush motor 72, the solution solenoid valve 52, or the suction motor 56. The robot extractor can then apply solution to the surface and optionally agitate the surface with the brush roll 34 as needed until the condition sensors 38 detect a predetermined level of acceptable color variation. Upon reaching the predetermined level of cleanliness, output signals to the solution solenoid valve 52 and the brush motor 72 cease and drive commands to the drive wheels 30 are resumed to begin movement of the robot extractor on a straight path once again.

Figure 7:
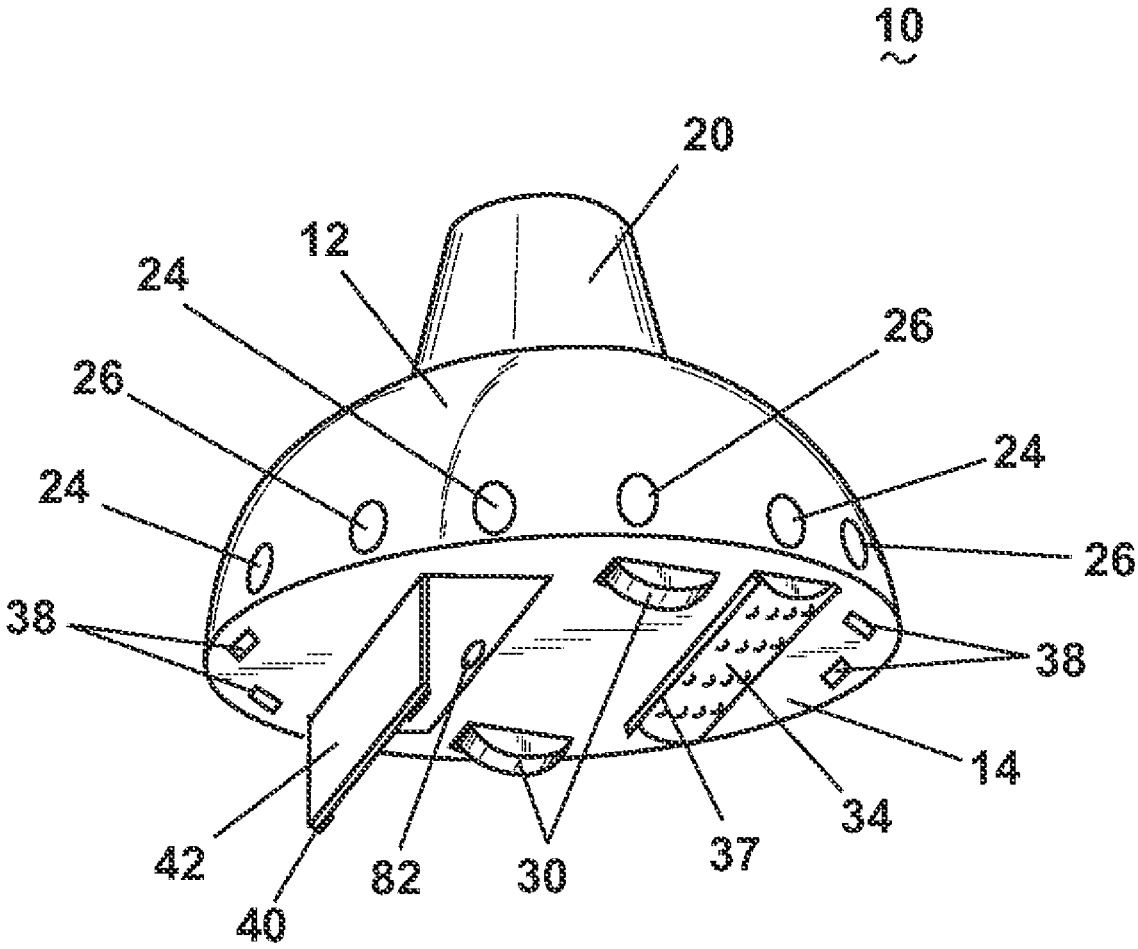
FIG. 7 is a perspective bottom view of the robotic extraction cleaner with dusting pad in open position as shown in FIG. 1.
Figure 8:
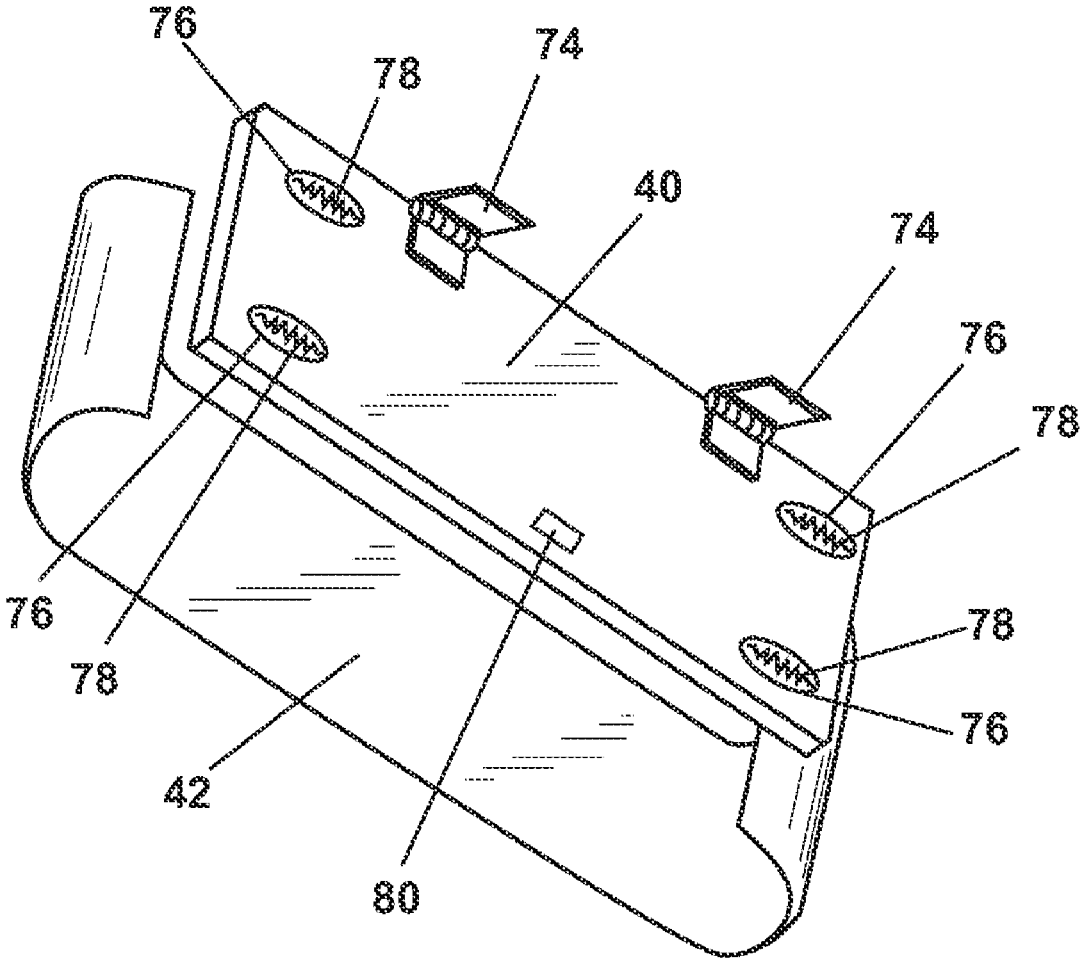
FIG. 8 is a perspective bottom view of the dusting pad of the robotic extraction cleaner with dusting pad as shown in FIG. 1.

Referring to FIGS. 2, 7, and 8, a dusting assembly is described comprising a dusting pad 40, a dusting cloth 42, and a plurality of hinges 74. The dusting pad 40 further comprises a plurality of engagement members 76 that rest along the bottom surface of the base 14. The cloth engagement members 76 are made from a resilient material including any number of commonly known plastics and further comprise a plurality of slots 78. The cloth engagement members 76 are similar to those disclosed in U.S. Pat. No. 6,305,046 to Kingry, specifically in FIGS. 4 through 7, which is hereby incorporated by reference herein in its entirety.

The dusting pad 40 is attached to the base 14 via the plurality of hinges 74 affixed along a length of one side of the dusting pad 40 and at the rear of the base 14 on the other. A commonly known magnetic latch 80 is affixed to a top surface of the dusting pad 40. A steel catch 82 is located on the underside of the base 14 such that the catch 82 aligns with the latch 80 when the dusting pad 40 is placed in the closed position as defined by the upper surface of the dusting pad 40 being in direct contact with the lower surface of the base 14. Magnetic force between the latch 80 and the catch 82 maintains contact between the top of the dusting pad 40 and the bottom of the base 14 during use. To open the dusting pad 40, the user applies hand force to overcome the magnetic force, allowing the dusting pad 40 to rotate about the hinges 74 which then allows access to the engagement members 76. Alternatively, the dusting pad 40 is fixedly attached to the bottom surface of the base 14. The cloth engagement members 76 are accessible from the bottom and the dusting cloth 42 is removed directly from the bottom.

The dusting cloth 42 is wrapped around the dusting pad 40 in a longitudinal direction. In the preferred embodiment, the dusting cloth 42 is an electrostatically charged dry cloth that attracts oppositely charged debris particles. In an alternate embodiment, the dusting cloth 42 is a pre-moistened cloth suitable for removing sticky stains. The dusting cloth 42 is attached to the pad 40 by forcing the cloth 42 into the slots 78, thus providing an easy method of inserting and removing the dusting cloth 42 from the unit as disclosed in FIG. 2 of U.S. Pat. No. 6,305,046 to Kingry.

In operation, the user connects the robot extraction cleaner 10 to facility power to energize the charging circuit. Once a full charge on the batteries 44 is achieved, the user removes the charging circuit from the robot extractor cleaner 10 and engages the electrical switch 28. Power is then delivered to the logic board 46. The logic board 46 controls output based on input from the proximity sensors 24, 26 and the floor condition sensors 38. The robot extraction cleaner 10 moves across the surface to be cleaned in a random fashion, changing speed and direction as the proximity sensors 24, 26 encounter obstructions and as inputs from the floor condition sensors 38 change. The logic board 46 directs the robot extraction cleaner 10 to move in a direction that prefers the suction nozzle 64 in a forward position and the dusting cloth 42 in a rearward position. As such, larger loose debris is removed from the surface before the dusting cloth 42 passes. This sequence allows for longer life of the dusting cloth 42 and improved cleaning of the surface. After use, the user turns the electrical switch 28 to the off position, thus interrupting power to the logic board 46. The user removes the recovery tank 20 from the top enclosure 12. Debris from the recovery tank 20 is dumped into an appropriate disposal receptacle. The now dirty dusting cloth 42 is removed from the dusting pad 40 by overcoming the magnetic latch 80, rotating the dusting pad 40 to the open position, removing the dusting cloth 42, and similarly properly disposing of the dusting cloth 42. A new dusting cloth 42 is attached. The recovery tank 20 is reattached to the top enclosure 12. The robot extraction cleaner 10 is reattached to the charging circuit to replenish power to the batteries 44, whereby the entire cleaning process may begin again.

While the preferred invention has been described as a robotic extraction cleaner, it can also be appreciated that several subsets of the preferred embodiment may be recombined in new and different ways to provide various configurations. Any of the floor condition sensor system, fluid distribution system, fluid recovery system, or agitation system may be used alone or in combination to create an apparatus to solve specific cleaning problems not requiring all the capabilities of all the subsystems herein described. Furthermore, while the invention is described as an extraction system, it may also describe a dry removal system whereby dry debris is withdrawn and deposited in a dirt receptacle or filter bag.

While the invention has been specifically described in connection with certain specific embodiments, it is to be understood that this is by way of illustration and not of limitation. Reasonable variation and modification are possible within the foregoing disclosure and drawings without departing from the spirit of the invention which is set forth in the appended claims.

The invention claimed is:

1. An autonomously movable home extraction cleaning robot comprising:

a) a base housing;

b) a drive system mounted to said base housing, said drive system adapted to autonomously move said base housing on a substantially horizontal surface having boundaries;

c) a computer processing unit for storing, receiving and transmitting data, said computer processing unit attached to said base housing;

d) a dusting assembly positioned at a rearward portion of said base housing, operatively associated with said base housing and adapted to selectively rest on a surface to be cleaned;

e) a suction nozzle positioned at a forward portion of the base housing for withdrawing dirt, debris and liquid from the surface to be cleaned;

f) a squeegee positioned rearwardly of and adjacent to the suction nozzle and adapted to contact the surface to be cleaned and adapted to collect dirt, debris and liquid from the surface to be cleaned for removal by suction through the suction nozzle;

g) a cleaning fluid delivery system having a fluid distributor positioned forwardly of the suction nozzle for depositing of a cleaning fluid on the surface to be cleaned;

h) a recovery tank mounted on the base housing and in fluid communication with the suction nozzle;

i) a suction source mounted to the base housing and in fluid communication with the suction nozzle and the recovery tank for drawing dirt, debris and liquid collected by the squeegee through the suction nozzle and depositing the same in the recovery tank; and j) a power source connected to said drive system and said computer processing unit, whereby said computer processing unit directs horizontal movement of said base housing within the boundaries of the surface to be cleaned based upon input data defining said boundaries.

2. The autonomously movable home extraction cleaning robot according to claim 1 and further comprising an agitator mounted on the base housing for agitating contact with the surface to be cleaned.

3. The autonomously movable home extraction cleaning robot according to claim 2 and further comprising floor condition sensors mounted on base housing for detecting a floor condition and for generating a control signal that forms a part of the input data to the computer processing unit.

4. The autonomously movable home extraction cleaning robot according to claim 3 wherein the computer processing unit controls at least one of the agitator, the delivery of fluid by the fluid delivery system, the suction source and the drive system in response to the control signal.

5. The autonomously movable home extraction cleaning robot according to claim 4 and further comprising proximity sensors mounted on base housing for detecting a the boundaries of the surface to be cleaned and for generating a second control signal that forms a part of the input data to the computer processing unit.

6. The autonomously movable home extraction cleaning robot according to claim 5 wherein the computer processing unit controls the drive system in response to the second control signal to keep the base housing within the boundaries of the surface to be cleaned.

7. The autonomously movable home extraction cleaning robot according to claim 3 wherein the computer processing unit controls at least one of the agitator, the suction source and the drive system in response to the control signal.

8. The autonomously movable home extraction cleaning robot according to claim 7 and further comprising proximity sensors mounted on the base housing for detecting the boundaries of the surface to be cleaned and for generating a second control signal that forms a part of the input data to the computer processing unit.

9. The autonomously movable home extraction cleaning robot according to claim 8 wherein the computer processing unit controls the drive system in response to the second control signal to keep the base housing within the boundaries of the surface to be cleaned.

10. The autonomously movable home extraction cleaning robot according to claim 1 wherein the input data is a remote control signal.

11. The autonomously movable home extraction cleaning robot according to claim 1 wherein the input data comprises a program that guides the base housing through a predetermined path on the surface to be cleaned.

12. The autonomously movable home extraction cleaning robot according to claim 1 wherein the drive system comprises at least one wheel that is driven by a drive motor.

13. The autonomously movable home extraction cleaning robot according to claim 1 wherein the dusting assembly is removably mounted to a pad that forms a support for the dusting assembly.

14. The autonomously movable home extraction cleaning robot according to claim 1 and further comprising floor condition sensors mounted on the base housing for detecting a floor condition and for generating a control signal that forms a part of the input data to the computer processing unit.

15. The autonomously movable home extraction cleaning robot according to claim 14 wherein the computer processing unit controls at least one of the suction source and the drive system in response to the control signal.

16. The autonomously movable home extraction cleaning robot according to claim 1 and further comprising proximity sensors mounted on the base housing for detecting the boundaries of the surface to be cleaned and for generating a second control signal that forms a part of the input data to the computer processing unit.

17. The autonomously movable home extraction cleaning robot according to claim 16 wherein the computer processing unit controls the drive system in response to the second control signal to keep the base housing within the boundaries of the surface to be cleaned.

18. The autonomously movable home extraction cleaning robot according to claim 1 and further comprising an agitator mounted within the suction nozzle for agitating contact with the surface to be cleaned.

19. The autonomously movable home extraction cleaning robot according to claim 1 wherein the dusting assembly comprises:

a dusting pad attached to a bottom surface of the base housing; and a removable dusting cloth associated with the dusting pad.

* * * * *